United States Patent [19]

Dunn

[11] 4,147,119

[45] Apr. 3, 1979

[54] SEWING MACHINE DUAL MODE BACKTACK CONTROL

[75] Inventor: William H. Dunn, Branchville, N.J.

[73] Assignee: The Singer Company, New York, N.Y.

[21] Appl. No.: 882,008

[22] Filed: Feb. 28, 1978

[51] Int. Cl.[2] ..... D05B 27/00; D05B 3/02; D05B 69/18

[52] U.S. Cl. ..... 112/317; 112/158 E; 112/121.11

[58] Field of Search ..... 112/158 E, 210, 121.11, 112/121.12, 2, 277

[56] References Cited

U.S. PATENT DOCUMENTS

| | | | |
|---|---|---|---|
| 3,977,338 | 8/1976 | Wurst et al. | 112/158 E |
| 4,080,914 | 3/1978 | Ishida et al. | 112/277 |

*Primary Examiner*—Peter Nerbun

*Attorney, Agent, or Firm*—Michael H. Wallach; Robert E. Smith; Edward L. Bell

[57] ABSTRACT

A dual mode backtack control system for a sewing machine is disclosed which permits an operator to select either a latched or non-latched backtacking mode of operation utilizing a single non-latching switch. The backtacking operation is initiated under operator command by closure of the switch. In the first mode of operation, the sewing machine is operating when the switch is closed, and the backtacking operation will continue only as long as the switch is held in the closed position. In the second mode of operation, the switch is closed before the machine commences the sewing operation, and the machine may then be operated in its backtacking mode without the operator maintaining the switch in its closed state. The backtacking mode may thereafter be terminated by a second momentary closure of the switch. An indicator lamp is provided to advise the operator when the machine is in the backtack mode.

8 Claims, 2 Drawing Figures

SEWING MACHINE DUAL MODE BACKTACK CONTROL

BACKGROUND OF THE INVENTION

1. Field of the Invention

This invention relates to electronically controlled sewing machines and more specifically to sewing machines having electronically controlled feed reversing devices for shifting the feed regulating mechanism into a mode for backtacking.

2. Description of the Prior Art

The use of switches for controlling the reversing of the feed regulating mechanism of a sewing machine is known in the prior art. See for example U.S. Pat. No. 3,977,338 of John W. Wurst et al which is owned by the assignee of this invention.

One problem associated with prior art backtacking mechanisms is that they typically require an operator to hold the switch depressed, thereby preventing the use of two hands to guide the workpiece.

Another problem with prior art backtacking controls is that they cannot be selectively locked in the backtack mode for completing lengthy backtack cycles.

It is therefore an object of this invention to provide an arrangement which will permit a sewing machine operator to select a continuous or a momentary backtack mode with only a single switch.

It is also an object of this invention to provide a backtack selection circuit which is compatible with electronic logic circuitry.

Still another object is to allow a sewing machine operator to backtack without having to hold a button while sewing.

An additional object is to construct a backtack control with a minimum number of additional circuit components.

SUMMARY OF THE INVENTION

The foregoing and additional objects are achieved in accordance with the principles of this invention by providing a single nonlatching switch and associated circuitry which permits the selection of a desired mode of backtacking operation.

The backtacking function is implemented by a logic circuit which accepts a command signal from the nonlatching switch and also accepts feed and bight synchronization and new pattern selection signals from the main sewing machine logic. In a preferred embodiment of this invention the duration of the backtacking operation is dependent on whether the sewing machine is operating when the nonlatching backtack switch is pushed. If the sewing machine is operating when the backtack switch is closed, the reverse feed function will continue for as long as the operator keeps the switch closed. The backtacking mode will terminate when the button is released. If the operator depresses and releases the button before the sewing process commences, the logic circuit will latch in the backtacking mode until the switch is closed a second time. If a new pattern is selected while the machine is sewing in a backtacking mode, the backtacking mode will also be terminated. Additionally, an indicator is provided to advise the operator when the machine is in the backtacking mode.

BRIEF DESCRIPTION OF THE DRAWINGS

The foregoing will be evident from an understanding of a preferred embodiment, a description of which is hereafter set forth in such detail as to enable those skilled in the art to readily understand the function, operation, and construction of it when read in conjunction with the accompanying drawings in which.

DESCRIPTION OF THE PREFERRED EMBODIMENT

This invention is adapted to be applied to any sewing machine having an ornamental stitch pattern system operating in response to electronic pattern information signals. The U.S. Pat. No. 3,872,808 dated Mar. 25, 1975 of J. W. Wurst, which discloses one sewing machine of this type, is incorporated herein by reference.

The above referenced U.S. Patent No. 3,872,808, includes a static electronic memory capable of storing a multiplicity of different stitch pattern instructions of which the stored information corresponding to any selected stitch pattern may be retrieved by way of an address memory, as described therein. The present invention may be used with the data storage and retrieval system of the referenced U.S. Pat. No. 3,872,808. Comparison of the disclosure of the referenced patent with that of the present invention may aid in an understanding of the present invention.

Figure 1:
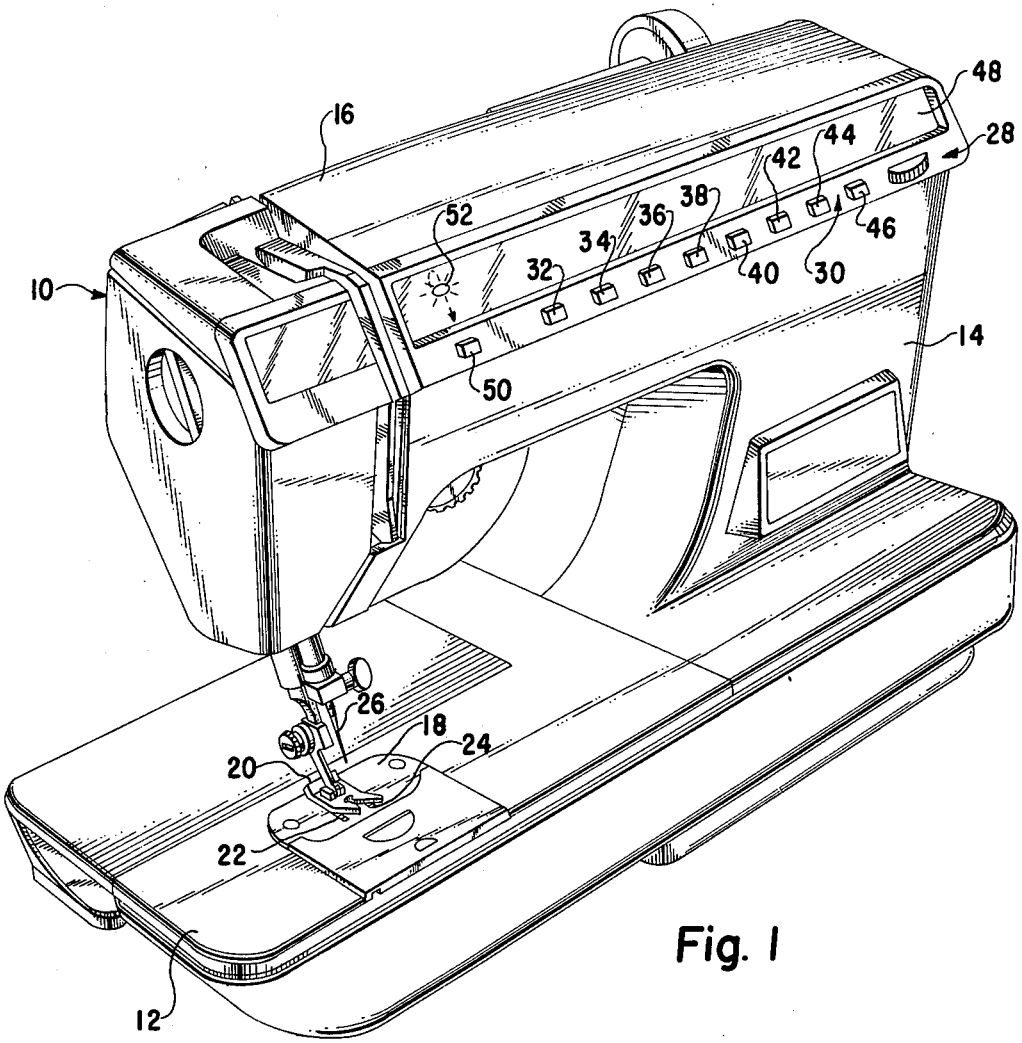
FIG. 1 is a front perspective view of a sewing machine to which this invention may be applied.

FIG. 1 of the drawings shows a sewing machine frame 10 including a work supporting bed 12 and a standard 14 rising from the bed which carries a bracket arm 16 overhanging the bed. A throat plate 18 is carried on the bed and supports the thrust of a presser foot 20 carried in the bracket arm. Work fabrics to be sewn are urged by the presser foot 20 downwardly against the throat plate and against a feed dog 22 which rises upwardly through slots 24 in the throat plate to feed the work. The throat plate also contains an aperture to accommodate the reciporcation of a needle 26 carried in the bracket arm.

The bracket arm of the sewing machine is preferably fitted with an operator influenced control panel 28 which may be constructed in accordance with that disclosed in U.S. Pat. No. 3,913,506 dated Oct. 21, 1975, of Kenneth D. Adams et al, which is incorporated herein by reference. The control panel includes an escutcheon plate 30 through which a plurality of pattern selection buttons 32, 34, 36, 38, 40, 42, 44 and 46 protrude, and a transparent insert 48 through which indicia in close association with the selector buttons is visible. A nonlatching backtacking button 50 which protrudes through the escutcheon plate 30 is provided for the purpose of selecting the backtacking mode. An indicator, shown preferably as a light emitting diode 52, is arranged on the transparent insert above the backtack button 50 to identify when the sewing machine is operating in the backtack mode. A more complete description of a switch which may be used as a backtack button may be had by reference to U.S. Pat. No. 3,977,338 dated Aug. 31, 1976 of John W. Wurst et al which is owned by the assignee of this invention and which is incorporated herein by reference.

Figure 2:
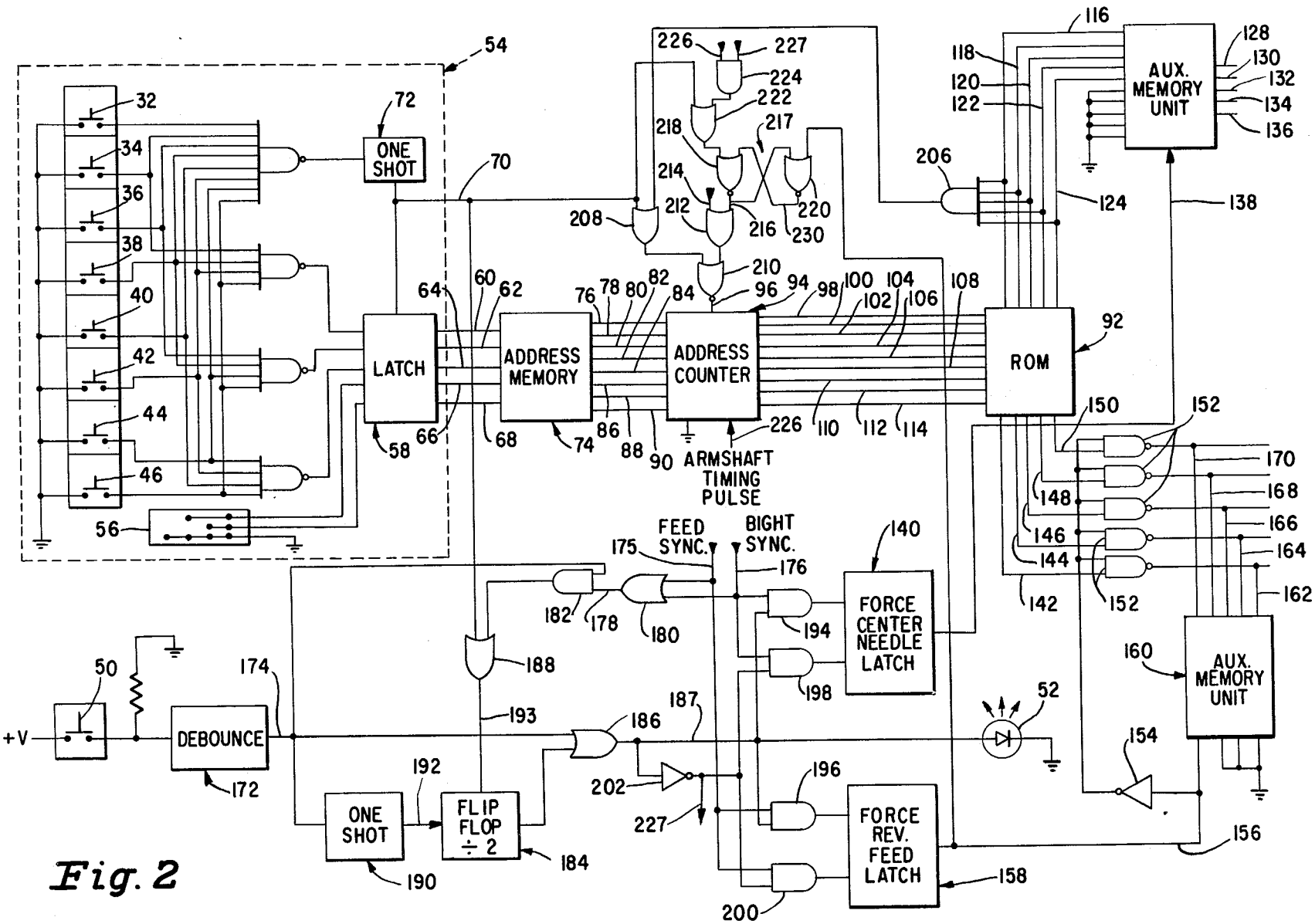
FIG. 2 is a schematic diagram of logic circuitry showing a sewing machine ornamental stitch pattern signal generating system operative in response to electronic pattern selection signals in which the feed reversing arrangement of this invention has been applied.

FIG. 2 shows an electronic logic diagram which remains substantially unchanged from that which is disclosed in the above-referenced U.S. Pat. No.

3,977,338. An examination of FIG. 2 will reveal that the pattern selector means 54, depending upon the setting of a switch 56 and depending upon which pattern selection button is depressed, results in the appearance of a digital code signal continuously on output lines 60, 62, 64, 66 and 68 from the latch 58 and also results in the generation of a pulse on the line 70 from the one shot circuit 72. The digital code signal on lines 60, 62, 64, 66 and 68 results in an output from the address memory 74 on lines 76, 78, 80, 82, 84, 86, 88 and 90 which continuously defines the starting word address of a group of consecutive word addresses in the Pattern ROM 902 constituting a stitch pattern. The address counter 94 is responsive to pulses on the line 96 consecutively to increase the address appearing on lines 98, 100, 102, 104, 106, 108, 110, 112 and 114 leading to the ROM 92.

It will be observed from FIG. 2 that the bight output lines 116, 118, 120, 122 and 124 lead from the ROM 92 to an auxiliary memory unit 126. The auxiliary memory unit 126 stores one pattern of stitch bight information corresponding, for instance, to center needle position. This information is applied to output lines 128, 130, 132, 134 and 136 leading to the bight actuator whenever a signal is applied to the line 138 leading to the auxiliary memory unit 126. In the absence of a signal on line 138 the auxiliary memory unit 126 will pass to the lines 128, 130, 132, 134 and 136 the stitch pattern information received on lines 116, 118, 120, 122 and 124.

The feed output lines 142, 144, 146, 148 and 150 are similarly not directly connected to the feed actuator but instead each passes through a respective NAND gate 152. One input of each of the NAND gates 152 is connected to the output of an inverter 154 whose input is supplied by a line 156 from the output of a force reverse feed latch 158. The output of the force reverse feed latch 158 will present a signal on lead 156 whenever the backtack mode is selected and the feed pattern information will then be interrupted by disabling the NAND gates 152. The signal from the output of the force reverse feed latch 158 will also be supplied via line 156 to an auxiliary memory unit 160 which stores one pattern of feed magnitude and direction information corresponding preferably to a reverse direction of feed of appreciable magnitude, for instance twelve stitches to the inch in a reverse direction. It should therefore be apparent that whenever the sewing machine is placed in the backtack mode the feed mechanism will no longer respond to the feed control pattern information from the ROM 92 but instead will be influenced by the output lines 162, 164, 166, 168 and 170 from the auxiliary memory unit 160 to dictate a work feed condition corresponding to that of a reverse feed.

When the backtack switch 50 is depressed the input of the debounce circuit 172 is connected to a positive source of voltage, resulting in a high, or one signal appearing on the output lead 174 of debounce circuit 172. The circuit is supplied with timing pulses on the leads 175 and 176 which are generated by the feed synchronization and bight synchronization detectors, respectively, and are related to the armshaft timing pulse in a manner with which the present invention is not concerned.

A backtack enable signal which is applied to the force center needle latch 140 and to the force reverse feed latch 158 to place the sewing machine in a backtack mode of operation may preferably be generated in two ways. Depressing the backtack switch 50 when the sewing machine is not operating raises the line 174 to a high, or one state. Since feed synchronization and bight synchronization signals are not generated when the machine is not operating, it will be observed that line 178 will remain low, or zero, since neither input to the OR gate 180 will be pulsed to a one state. The AND gate 182 will therefore not be enabled and, therefore, the reset line 193 coupled to the FLIP FLOP 184 remains low. The FLIP FLOP 184 will be set by the output of the debounce circuit 172 which will appear on line 174 and will trigger the one shot 190 to generate a pulse on line 192. The FLIP FLOP 184 is a toggle FLIP FLOP which remains in one state until a toggle input is received from the one shot 190 on line 192 which will change its state. The FLIP FLOP will therefore act as a memory cell. The FLIP FLOP 184 will therefore be toggled to a set state, thereby providing a high signal to the OR gate 186 since it will not be reset by the OR gate 188. Since the reset line 193 is low, the FLIP FLOP 184 will serve as a memory and will therefore remain in its set state with a one in its output lead 185 until reset by a signal in the lead 193 from the OR gate 188. The output of the FLIP FLOP 184 constitutes one input to the OR gate 186 which is enabled by a set state existing in the FLIP FLOP 184.

The force center needle latch 140 and the force reverse feed latch 158 each have an AND gate controlling the set and the reset input functions of the latches. The AND gate 184 controls the conditions under which the force center needle latch 140 is set and the AND gate 196 controls the conditions under which the force reverse feed latch 158 is set. Similarly, the AND gate 198 controls the conditions under which the force center needle latch is reset and the AND gate 200 controls the conditions under which the force reverse feed latch is reset.

When the OR gate 186 is enabled, a backtack mode signal is applied to lead 187. This backtack mode signal enables one input of the AND gate 194 and one input of the AND gate 196. Operation of the sewing machine after the backtack switch 50 has been depressed will cause the application of a feed synchronization pulse to the other input of AND gate 196 and the application of a bight synchronization pulse to the other input of the AND gate 194 which will result in the enabling of the AND gates 194 and 196 with the resulting change in the state of the outputs of the force center needle latch 140 and force reverse feed 158 latch to the set state. The set state of the output of the force center needle latch 140 will result in the center needle position information stored in the auxiliary memory unit 126 being transferred to the bight actuator through the lines 128, 130, 132, 134 and 136. Similarly, the set state of the force reverse feed latch 158 will result in the feed direction and magnitude information stored in the auxiliary memory unit 160 being transferred to the feed actuator through the lines 162, 164, 166, 168 and 170.

An indicator 52, shown in the preferred embodiment as a light emitting diode, is connected to the output of the OR gate 186. The indicator turns on each time that the backtack switch is depressed to select the backtack mode, thereby warning the sewing machine operator of the reverse feed cycle.

An inverting gate 202 is connected between the output of the OR gate 186 and the input to the AND reset gates 198 and 200. The inverter places a low logic state on one of the inputs to the AND gates 198 and 200, thereby assuring that the force center needle latch 140 and the force reverse feed latch 158 are not reset during the backtacking operation. When the backtacking operation is completed, the output of the OR gate 186 is in a low state and the output of the inverter gate 202 is therefore in a high state. Bight synchronization pulses and feed synchronization pulses appear on the inputs to the AND gates 198 and 200 respectively, and together with the high state of the inverting gate 202 act to enable the AND gates 198 and 200, thereby resetting the force center needle latch 140 and the force reverse feed latch 158.

Since the FLIP FLOP 184 will not be reset until the backtack switch 50 is depressed a second time, the sewing machine will continue to operate in the backtacking mode without a need for the operator to continuously depress the backtack switch 50. It will therefore be apparent that the operator can safely devote two hands to guiding the work piece until it is desired to disengage the backtack mode. When the backtack switch 50 is depressed a second time both the input from the switch 50 and the input from the OR gate 180 to the AND gate 182 will be enabled and therefore the input to the OR gate 188 will enable the reset line 193, thereby resetting the FLIP FLOP 184, and terminating the backtacking mode. If the sewing machine is not operating when the backtack switch 50 is depressed a second time, the FLIP FLOP 184 will be toggled to its reset state and the backtack mode will be terminated at the start of the next machine cycle by the enabling of the AND gates 198 and 200 through the output of the inverter 202.

The backtacking mode may also be engaged while the sewing machine is operating, in which case the machine will remain in backtack mode only as long as the backtack switch is held depressed. It should be remembered that while the sewing machine is operating, pulses are being supplied on lines 175 and 176 by the feed synchronization and bight synchronization detectors respectively. The feed and bight synchronization pulses form the inputs to the OR gate 180 which cause the output line 178 of the OR gate 180 to be maintained in a high state. The debounce circuit 172 forms one input to the AND gate 182 while the output of the OR gate 180 constitutes the second input. Thus the AND gate 182 will remain turned on for as long as the backtack button is depressed while the sewing machine is operating, thereby maintaining the OR gate 188 in an enable state. It will thereby be apparent that the reset line 193 of the FLIP FLOP 184 will repetitively reset the FLIP FLOP as long as the backtack button 50 is depressed and the sewing machine is operating. It will be appreciated that the backtack mode will be maintained even as the FLIP FLOP 184 is being constantly reset, due to the enabled state of the line 174 which maintains the OR gate 186 in a high condition. It will be further appreciated that when the backtack button 50 is released the OR gate 186 will be disabled since the FLIP FLOP 184 will have been reset by signals on the reset line 193 from the OR gate 188.

The selection of a new pattern by operation of the pattern selector shown generally at 54 will cause a pulse to appear on the line 70 which will thereby terminate the backtacking mode by enabling the OR gate 188.

The address memory 74 continuously impresses a beginning of pattern address on the lines 76, 78, 80, 82, 84, 86, 88 and 90 to the address counter 94. The address counter counts as long as a high signal is present on line 96 and upon the interruption of the signal on line 96, i.e. a low or zero condition, the counter will reset to whichever beginning-of-pattern number is present on lines 76, 78, 80, 82, 84, 86, 88 and 90 from the address memory 74. The AND gate 206 and the OR gate 208 which respond, respectively, to the end-of-pattern signal and to selection of a new pattern, in the present invention, supply inputs to a NOR gate 210, the output of which is connected to the reset line 96 of the address counter 94.

Another input to the NOR gate 210 is the output of an OR gate 212. A signal appearing at either input to the OR gate 212 will cause resetting of the counter 94. The lead 214 is from a circuit influenced by means with which the present invention is not concerned. The lead 216 is the output of a FLIP FLOP circuit 217 comprising two cross coupled NOR gates 218 and 220. One input to the FLIP FLOP 217 is connected to the output line 156 of the force reverse feed latch 158 which remains in a low or zero state during normal stitching and carries a signal only during operation in the backtack mode. The other input to the FLIP FLOP 217 is from a circuit including an OR gate 222 and an AND gate 224. One of the inputs to the OR gate 222 is the output of the AND gate 224 which has two inputs, one from the line 226, which is an armshaft timing pulse, and the other from the line 227, the output of inverter 202, which carries a signal only while the backtack switch 50 is open.

To summarize the aforementioned operation, during normal sewing operations, therefore, and when the force reverse feed latch 158 remains reset, the address counter 94 will remain effective during the entire sequence of addresses for the selected pattern of stitches and will be reset only upon receipt of an end-of-pattern signal from the AND gate 206 or upon receipt of a signal on line 70 when a new pattern has been selected. The output of the FLIP FLOP 217 on the lead 216 will remain low while there is no signal from the output of the force reverse feed latch 158.

The absence of a signal from the force reverse feed latch 158 and on the line 216 in the FLIP FLOP 217 will result in a signal being generated on the line 230 of the FLIP FLOP 217 during normal sewing operation, and because of this, signals directed to the FLIP FLOP 217 from the OR gate 222 will have no effect.

Upon setting of the force reverse feed latch 158, however, a signal on the input to the FLIP FLOP 217 from the output of the force reverse feed latch 158 will cause the output of the FLIP FLOP 217 to change, giving rise to an output signal which will be directed to the address counter reset line 96 causing the address counter 94 to be reset. This condition will persist for as long as the force reverse feed latch 158 is set.

Upon resetting the force reverse feed latch 158, the input to the FLIP FLOP 217 supplied by the OR gate 222 can become effective and the line 227 to an input of the AND gate 224 will carry a signal. The next receipt of an arm shaft timing pulse signal on lead 226 to the AND gate 224 will toggle the FLIP FLOP 217 shifting its output on lead 216 to an off condition, again conditioning the address counter 94 for normal operation.

It will be appreciated from the above that upon each operation of the backtack switch 50, not only will the stitch length and direction be shifted to that of the backtack mode, but the sewing machine will revert to straight stitching preferably in center needle position, and furthermore, whichever stitch pattern has been effective will be interrupted. When the backtack mode is terminated, the stitch pattern which had been interrupted will be reinstated at the beginning of the stitch pattern.

It is also to be noted that the disclosed invention is advantageous in that the above described changes in the mode of operation of the machine will be accomplished utilizing the identical means which are used during normal stitching operations, the change being influenced by a substitution of stitch pattern influencing signals thus providing for profound changes in the operation of the sewing machine without the necessity for the provision of complicated parallel sets of actuating and control mechanisms.

Accordingly, there has been disclosed an arrangement utilizing only a single switch, which arrangement permits a sewing machine operator to select either a continuous or a momentary backtack mode. It is understood that the above-described arrangement is merely illustrative of the application of the principles of this invention. Although a conventional two terminal switch has been disclosed herein, it is contemplated that other operator influenced actuators may be utilized in applying the teachings of this invention. For example, a touch sensitive area coupled to circuitry responsive to a prescribed application of operator influence, such as is disclosed in my copending application Ser. No. 882,006, filed concurrently herewith, may be utilized in place of the disclosed switch. Numerous other arrangements may be devised by those skilled in the art without departing from the spirit and scope of this invention, as defined by the appended claims.

Having thus set forth the nature of the invention, what is claimed herein is:

1. In a sewing machine having stitch forming instrumentalities including a reversible work feeding mechanism, an actuating mechanism for said stitch forming instrumentalities and a work feed reversing system controlled by a single operator influenced actuator having two states, said actuator normally being in a first of said states when there is no operator influence thereon, means for providing two different modes of operation of said work feed reversing system comprising:

signal generating means associated with said actuating mechanism and effective differentially for indicating an operative from an inoperative condition of said actuating mechanism;

circuit means including said single operator influenced actuator and means responsive to an indication from said signal generating means of an operative condition of said actuating mechanism for establishing one mode of operation of said work feed reversing system in which said work feed mechanism is reversed only while said actuator is maintained by operator influence in the other of said states; and means in said circuit means responsive to an indication from said signal generating means of an inoperative condition of said actuating means for establishing another mode of operation of said work feed reversing system in which said work feed mechanism when reversed by operator influence of said actuator into said other state is maintained in reverse upon return of said actuator into said first state by removal of operator influence from said actuator, and said work feeding mechanism is shifted out of reverse by a succeeding operator influence of said actuator into said other state followed by a return of said actuator to said first state.

2. In a sewing machine according to claim 1 wherein said actuator comprises a switch having a first terminal, a second terminal spaced from said first terminal and a movable contact arranged so that said movable contact electrically connects said first terminal to said second terminal upon operator influence thereon to define said other state.

3. In a sewing machine according to claim 2 wherein said switch further includes means for biasing said movable contact so that said first and second terminals are not electrically connected in the absence of operator influence on said movable contact.

4. A dual mode backtack control arrangement for a sewing machine having a reversible work feeding mechanism and a work feed reversing system responsive to a backtack mode signal for operating said work feeding mechanism in a backtack mode, said dual mode backtack control arrangement comprising:

a switch having a first state and a second state, said switch being normally in said first state and being operator controllable to said second state;

signalling means for providing an operating signal when said sewing machine is operating;

latching means responsive to said switch being in said second state for providing said backtack mode signal;

first mode terminating means responsive to said operating signal and said switch being in said second state for controlling said latching means to terminate said backtack mode signal when said switch returns to its first state; and second mode terminating means responsive to a transition of said switch from its first to its second state and to said machine being in said backtack mode for controlling said latching means to terminate said backtack mode signal when said switch returns to its first state.

5. The arrangement according to claim 4 wherein said latching means includes:

means responsive to said switch being in its second state for providing a first signal;

two state memory means responsive to a first transition of said switch from its first to its second state for switching to its first memory state and providing a second signal; and means responsive to the presence of either said first or said second signal for providing said backtack signal.

6. The arrangement according to claim 5 wherein said memory means includes a two state toggle flip flip having an output terminal connected to provide said second signal when said toggle flip flop is in its first state and means coupled between said switch and the toggle input of said flip flop for providing a toggle signal to said flip flop upon a transition of said switch from its first to its second state.

7. The arrangement according to claim 5 wherein said first mode terminating means includes means responsive to said operating signal while said switch is in its second state for controlling said memory means to switch to its second memory state and remove said second signal.

8. The arrangement according to claim 5 wherein said second mode terminating means includes means responsive to a second transition of said switch from its first to its second state for controlling said memory means to switch to its second memory state and remove said second signal.

* * * * *